US005346790A

United States Patent [19]

Sacripante et al.

[11] Patent Number: 5,346,790

[45] Date of Patent: Sep. 13, 1994

[54] TONER COMPOSITIONS AND PROCESSES THEREOF

[75] Inventors: Guerino G. Sacripante, Oakville; Michael K. Georges, Guelph; Grazyna Kmiecik-Lawrynowicz, Burlington, all of Canada; Timothy J. Fuller, W. Henrietta, N.Y.

[73] Assignee: Xerox Corporation, Stamford, Conn.

[21] Appl. No.: 990,476

[22] Filed: Dec. 14, 1992

[51] Int. Cl.[5] ..... G03G 9/00

[52] U.S. Cl. ..... 430/106; 430/109; 430/111; 430/137

[58] Field of Search ..... 430/106, 109, 110, 111, 430/137, 138

[56] References Cited

U.S. PATENT DOCUMENTS

| | | | |
|---|---|---|---|
| 4,797,339 | 1/1989 | Maruyama et al. | 430/109 |
| 4,876,313 | 10/1989 | Lorah | 525/281 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |

*Primary Examiner*—Steve Rosasco

*Attorney, Agent, or Firm*—John L. Haack

[57] ABSTRACT

A process for the preparation of a toner comprising: preparing an organic phase comprised of a first nonpolar olefinic monomer, a second nonpolar diolefinic monomer, a pigment, a free radical initiator, and optionally a charge control agent; adding the organic phase to an aqueous phase comprised of at least one surfactant; shearing the organic phase into the aqueous phase to form a microdroplet suspension of the organic phase dispersed in the aqueous phase; heating and polymerizing the microdroplets in the suspension to form nonpolar olefinic resin particles; halogenating the nonpolar olefinic resin particle mixture to form a nonpolar toner having a halopolymer resin outer surface or encapsulating shell; and optionally isolating the surface halogenated nonpolar toner.

26 Claims, No Drawings

TONER COMPOSITIONS AND PROCESSES THEREOF

BACKGROUND OF THE INVENTION

This invention is generally directed to toner and developer compositions, and, more specifically, the present invention is directed to toner compositions and processes for the preparation of toner compositions. In embodiments, there are provided in accordance with the present invention in situ processes for the preparation of toner compositions with average volume particle sizes equal to, or less than about 10 micrometers in embodiments without resorting to classification. The resulting toners can be selected for known electrophotographic imaging and printing processes, including color processes, and ionography. In an embodiment, the present invention is directed to a process for preparing a toner comprised of resin particles comprised of a nonpolar copolymer resin, a pigment, optionally a charge control agent, and wherein the resin particles have chemically modified outer surfaces and an average diameter of about 1 to 10 micrometers. In embodiments, the process of the present invention comprises preparing an aqueous suspension by agitating and subsequently polymerizing a mixture of nonpolar olefins such as styrene and butadiene in an aqueous medium containing a mixture of a free radical initiator, a surfactant, a pigment, and polymerizing the mixture by heating to form nonpolar olefinic resin particles suspended in water comprised of, for example, poly(styrene-butadiene) of from about 3 to about 10 micrometers in diameter; chemically modifying the resin particle resin particle surface with, for example, chlorine gas to transform the olefinic resin present on the outer surface of the toner particle to, for example, a chlorinated poly(styrene-butadiene) species poly(styrene-butadiene-dichloro butene); and optionally isolating the toner particles by centrifuging, washing and drying. The toner and developer compositions of the present invention can be selected for electrophotographic, especially xerographic imaging and printing processes, including color processes.

In an embodiment of the instant invention a process for the preparation of nonpolar toner particle compositions is disclosed comprising: preparing an organic phase comprised of a first nonpolar olefinic monomer, a second nonpolar diolefinic monomer, a pigment, a free radical initiator, and optionally a charge control agent; adding the organic phase to an aqueous phase containing at least one surfactant; shearing the organic phase into the aqueous phase to form a microdroplet suspension of the organic phase dispersed in the aqueous phase; heating and polymerizing the microdroplets in the suspension to form nonpolar olefinic resin particles; halogenating the nonpolar olefinic resin particle mixture to form nonpolar toner particles having a halopolymer resin outer surface or encapsulating shell; and optionally isolating the surface halogenated nonpolar toner particles. Flow additives to improve flow characteristics may then optionally be employed such as Aerosils or colloidal silicas, and the like, of from about 0.1 to about 10 percent by weight of the toner.

In another embodiment the present invention is directed to a process for the preparation of a toner composition comprising: milling a mixture of a polymeric resin a pigment and optionally an organic solvent and a charge control additive; homogenizing the mixture in an aqueous solution containing a surfactant or mixture of surfactants; heating the homogenized mixture obtained to form toner particles; halogenating the toner particles to form toner particles having a halopolymer resin outer surface or encapsulating shell; and optionally isolating the surface halogenated toner particles.

In yet another embodiment the present invention is directed to a process for the preparation of a toner composition comprising: preparing a suspension by shearing into a water containing mixture of a surfactant, a first nonpolar olefinic monomer, a second nonpolar olefinic monomer, a thermoplastic resin preferably as a fine powder, a pigment and optionally a charge control agent; polymerizing the suspension by heating to form toner resin particles; halogenating the toner particles to form toner particles having a halopolymer resin outer surface or encapsulating shell; and optionally isolating the surface halogenated toner particles, or toner composition.

In still yet another embodiment the present invention is directed to a process for the preparation of a toner composition comprising: preparing a suspension by shearing into water containing a mixture of a surfactant, a thermoplastic resin dissolved in a low boiling organic solvent, a pigment and optionally a charge control agent; heating the suspension; removing the organic solvent thereby generating a suspension of particles in water; halogenating the suspended particles to form toner particles having a halopolymer resin outer surface or encapsulating shell; and optionally isolating the surface halogenated toner particles.

In reprographic technologies, such as xerographic and ionographic devices, toners with small average volume diameter particle sizes of from about 5 microns to about 20 microns are utilized. Moreover, in some xerographic technologies, such as the high volume Xerox Corporation 5090 TM copier-duplicator, high resolution characteristics and low image noise are highly desired, and can be readily attained utilizing small sized toners with average volume particle of less than 11 microns and preferably less than about 7 microns and with narrow geometric size distribution (GSD) of less than about 1.4 and preferably less than about 1.3. Additionally, in some xerographic systems wherein process color is required such as pictorial color applications, small particle size colored toners of less than 9 microns and preferably less than about 7 microns are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present such as in black or highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper receiving sheet from sufficiently absorbing the moisture lost during the fusing step, and image paper curling results. Since surface area of the toner particle is inversely proportional to toner particle size, it is preferable to use small toner particle sizes of less than 9 microns and preferably less than about 7 microns and with higher pigment loading such that the mass of toner layers deposited onto paper is reduced to obtain the same quality of image and resulting in a thinner plastic toner layer onto paper after fusing, and hence, minimizing or avoiding paper curling. Toners prepared in the present invention with lower fusing temperatures such as from about 100° to about 140° C. help to avoid paper curl. Lower fusing temperatures minimize the loss of moisture from paper, thereby reducing or eliminating paper curl. Furthermore, in process color applications and especially in pictorial color applications, high gloss is necessary, as well as high projection efficiency properties with transparency images.

Numerous processes are known for the preparation of toners, such as, for example, conventional processes wherein a resin is melt kneaded or extruded with a pigment, micronized and pulverized to provide toner particles with an average volume particle diameter of from about 7 microns to about 20 microns and with broad geometric size distribution of from about 1.4 to about 1.7. In such processes it is usually necessary to subject the aforementioned toners to a classification procedure such that the geometric size distribution of from about 1.2 to about 1.4 are attained. However, in the aforementioned conventional process, low toner yields after classifications may be obtained and are dependent on the average volume particle sizes of said toner. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of from about 3 microns to about 9, and preferably 7 microns are attained without resorting to classification processes, and wherein high toner yields are attained such as from about 90 percent to about 98 percent in embodiments. Additionally, toners prepared by conventional processes must not readily aggregate or block during manufacturing, transport or storage prior to use in electrophotographic systems and must exhibit low temperature fusing properties in order to minimize fuser energy requirements. Accordingly, conventional toner resins are restricted to having glass transition temperatures of greater than about 55° C. and preferably of about 60° C. to satisfy caking or blocking requirements. Toner caking or blocking is known in the art and refers to the minimum temperature necessary for toner aggregation to occur over an extended period of time, such as from about 24 hours to 48 hours. The caking or blocking temperature requirement of a toner should be greater than about 55° C. and preferably greater than about 60° C., in order to avoid toner aggregation in storage or use prior to fixing a powdered toner image to a receiver sheet. This blocking requirement restricts the toner fusing properties, that is minimum fix temperature, of from about 135° C. to about 160° C. In process color or pictorial applications, wherein low paper curl is a requirement, low toner fusing properties are desired such as less than about 140° C. and preferably less than 110° C. such that moisture evaporation or removal from paper is minimized or preferably avoided. With the toners of this invention, the toners fuse at lower temperatures than conventional toners, such as from about 110° to about 150° C., thereby reducing the energy requirements of the fuser and more importantly resulting in reduced moisture being driven off from the paper during fusing, and hence lowering or minimizing paper curling. For the toners of this invention, the blocking and fusing properties of the toners are disintegrated or separated by the chemical surface process of halogenating the toner surface. During the process for the preparation of the toner of this invention, the polymerized resin or resins as toner particles such as poly (styrene-butadiene) exhibit a glass transition temperature of from about 40° C. to about 50° C. and thermal properties amenable to achieve low fusing properties such as from about 110° C. to about 140° C. In the optional halogenation or chlorination step, the outer surface of the toner resin particle surface is chemically transformed from poly(styrene-butadiene) to, for example, chlorinated poly(styrene-butadiene) such that the outer surface of the toner resin particle has a glass transition of from about 55° C. to about 60° C. necessary for the blocking requirement. This latter chemical surface treatment step allows one to separate toner blocking requirements from fusing requirements and results in low fusing toners of from about 110° C. to about 140° C. which are necessary to minimize or eliminate paper curling. That is, by lowering the fusing temperature range to about 100° to 140° C. a reduction or elimination in paper curl is achieved. In addition, by the toner particle preparation process of this invention, small particle size toners of from about 3 microns to about 7 microns are prepared with high yields as from about 90 percent to about 98 percent by weight of all toner starting material ingredients.

Additionally, other processes such as and including encapsulation, coagulation, coalescence, suspension polymerization, or semi-suspension and the like, are known, wherein the toners are obtained by in situ one pot methods. Moreover, encapsulated toners are known wherein a core comprised of pigment and resin is encapsulated by a shell, and wherein the toner melt rheological properties are separated wherein a core material provides low fusing properties such as from about 100° to 125° C. and an encapsulating shell provides necessary blocking properties for particle stability prior to fusing. However, it is known that encapsulated toners do not provide high gloss due to high surface tension, high glass transition and high melting temperatures of the shell, and also result in poor projection efficiency due to the difference in refractive index between the shell and core resulting in light scattering. Other in situ toners prepared by suspension, coagulation, coalescence, are known, wherein the toners are comprised of substantially similar compositions to conventional toners with, in some cases, having surfactants or surface additives on the toner surface prepared by various processes. Although, these latter aforementioned toners are amenable to high gloss, high projection efficiency, and small particle size toners, their fusing performances are restricted to the thermal properties of the bulk toner, such as glass transition ($T_g$), in that the toners must satisfy blocking requirements and hence are restricted to glass transitions of above 55° C. and therefore fusing temperatures of from about 135° to about 160° C., and have inferior paper curl properties for process color applications. By the processes of the present invention, toner melt rheological properties are separated in that a heterogeneous surface halogenation chemical process increases the glass transition of the outer surface resin of the toner particle of from about 45° to 55° C. to about 55° to 60° C. or greater, hence providing required blocking properties and low fusing temperatures of from about 110° C. to about 140° C. necessary for minimizing or avoiding paper curling.

The following patents, the disclosures of which are entirely incorporated herein by reference, are also mentioned.

Illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see, for example, columns 4 and 5. In column 7 of the '127 patent it is indicated that the toner can be prepared by mixing the required amount of coloring agent and optional charge additive with an emulsion of the polymer having an acidic or basic polar group obtained by emulsion polymerization as indicated in column 3. Additionally, note column 9, line 50 to 55, wherein polar monomers such as acrylic acid in the emulsion resin is necessary, and note Comparative Example 1, column 9, lines 50 to 55 wherein toner preparation is not obtained without the use of a polar group such as acrylic acid. Unlike the '127 reference, the present invention is directed to improved processes wherein suspended monomers or polymers, or dissolved polymer resins, or resultant composite resin particles do not contain acidic or basic groups, and toner particles are obtained without the use of polar acidic groups such as acrylic acid, thereby reducing toner humidity sensitivity. Additionally, with processes of the instant invention, halogenation, for example, chlorination of the outer surface of the toner particles provides an improvement in blocking characteristics, and hence enhances the minimum fix temperature properties of the toner.

Illustrated in U.S. Pat. No. 4,797,339, is a toner composition comprised of an inner layer comprising a resin ion complex having a coloring agent, a charge enhancing additive and pigment dispersed therein, and an outer layer containing a flowability imparting agent. Note column 2 and 3, wherein the ion complex resin is comprised of an acidic emulsion copolymer resin and basic emulsion resin comprised of styrene acrylates containing acidic or basic polar groups similar to the '127 patent.

U.S. Pat. No. 4,983,488 discloses a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100 micrometers in diameter, and particularly 3 to 70 micrometers in diameter, are obtained. It is also indicated in column 4, lines 60 to 65, that the glass transition of the emulsion resin should be above 50° C., and when the glass transition is too low, caking resistance, that is resistance to blocking, tends to decrease and if the glass transition is too high the fixing property tends to be poor. The toners of the present invention differ from the '488 reference toners in that the process is simple and does not utilize coagulating agents. Moreover, resins or resin blends with relatively lower glass transition of about 40° to 45° C. are used, and resistance to caking is avoided by the halogenation process of the toner surface wherein the glass transition is raised to about 50° to about 55° C., hence caking, blocking or undesired aggregation of toner particles is avoided and low fixing temperatures are maintained as well as excellent triboelectric characteristics, high gloss, and low humidity sensitivity.

Documents disclosing toner compositions with charge control additives include U.S. Pat. Nos. 3,944,493; 4,007,293; 4,079,014; 4,394,430; and 4,560,635 which illustrates a toner with a distearyl dimethyl ammonium methyl sulfate charge additive. These toners are prepared, for example, by the usual known jetting, micronization, and classification processes. Toners obtained with these processes generally possess a toner volume average diameter of form between about 10 to about 20 microns and are obtained in yields of from about 85 percent to about 98 percent by weight of starting materials without classification procedure.

Copending application U.S. Ser. No. 07/767,454 (D/90156), filed Sep. 30, 1991, the disclosure of which is totally incorporated herein by reference, discloses an in situ suspension process for preparing a toner comprised of a core comprised of a resin, pigment and optionally charge control agent and coated thereover with a cellulosic material. Also, in U.S. Pat. No. 5,278,016 (D/90514), filed May 6, 1991 entitled 'Toner Compositions', the disclosure of which is totally incorporated herein by reference, there is illustrated low melt toner particles prepared by conventional comminution processes that are subsequently halogenated to form encapsulated toner particles with a higher melting halopolymer shell. U.S. Pat. No. 5,278,020 (D/92097), filed Aug. 28, 1992, the disclosure of which is totally incorporated herein by reference, discloses a toner composition and processes for the preparation thereof comprising, for example, the steps of: (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent; (ii) polymerizing the latex emulsion mixture by heating from ambient temperature to about 80° C. to form nonpolar olefinic emulsion resin particles of volume average diameter from about 5 nanometers to about 500 nanometers; (iii) diluting the nonpolar olefinic emulsion resin particle mixture with water; (iv) adding to the diluted resin particle mixture a colorant or pigment particles and optionally dispersing the resulting mixture with a homogenizer; (v) adding a cationic surfactant to flocculate the colorant or pigment particles to the surface of the emulsion resin particles; (vi) homogenizing the flocculated mixture at high shear to form statically bound aggregated composite particles with a volume average diameter of less than or equal to about 5 microns; (vii) heating the statically bound aggregate composite particles to form nonpolar toner sized particles; (viii) optionally halogenating the nonpolar toner sized particles to form nonpolar toner sized particles having a halopolymer resin outer surface or encapsulating shell; and (ix) isolating the nonpolar toner sized composite particles.

Additionally, U.S. Pat. No. 4,876,313, discloses an improved core and shell polymers having an alkali-insoluble core and an alkali-soluble shell which polymers are prepared by emulsion polymerization of the core-shell polymers utilizing compounds which chemically graft the core and shell polymers together.

There remains a need for black or colored toners having small particle sizes of less than or equal to 7 microns in volume diameter. Furthermore, there is a need for colored toner processes wherein the toner synthetic yields are high, such as from about 90 percent to about 100 percent while avoiding or without resorting to classification procedures. In addition, there remains a need for black and colored toners that are nonblocking, such as from about 55° to about 60° C., of excellent image resolution, non-smearing and of excellent triboelectric charging characteristics. Moreover, there remains a need for black or colored toners with: low fusing temperatures, of from about 110° C. to about 150° C.; of high gloss properties such as from about 50 gloss units to about 85 gloss units; of high projection efficiency, such as from about 75 percent to about 95 percent efficiency or more; and which toners enable developed images with minimal or no paper curl.

SUMMARY OF THE INVENTION

It is an object of the present invention to provide toner compositions with many of the advantages illustrated herein.

In another object of the present invention there are provided suspension polymerization processes for the preparation of nonpolar toner particle compositions wherein micronizing, jetting, and classification can in embodiments be avoided.

In yet another object of the present invention there are provided toner compositions with small particle size of, for example, from about 1 to about 7 microns in average volume diameter as determined by known means as, for example, a Coulter Counter.

In another object of the present invention there are provided nonpolar toner compositions of high yields of from about 90 percent to about 100 percent by weight of toner and without resorting to classification.

In yet another object of the present invention there are provided toner compositions with low fusing temperature of from about 110° C. to about 150° C. and of excellent blocking characteristics of more than about 55° C. to about 60° C.

Another object of the present invention there are provided toner compositions with high gloss such as from about 45 gloss units to about 85 gloss units.

Moreover, in another object of the present invention there are provided toner compositions with high projection efficiency such as from about 75 to about 95 percent efficiency.

It is a further object of the present invention there are provided toner compositions which result in low paper curl.

Another object of the present invention resides in providing suspension polymerization processes for nonpolar toner compositions by suspending and homogenizing organic phase components of the composition in aqueous solution to obtain desired toner sized particles comprised of nonpolar monomers and/or resin particles and optional pigment particles and wherein the resulting toner particles possess an volume average diameter of from between about 3 to 15, and preferably from between about 3 to about 7 microns.

Also, in another object of the present invention there are provided developer compositions with nonpolar toner particles obtained by the processes illustrated herein, carrier particles, and optional enhancing additives or mixtures of these additives.

Another object of the present invention resides in the formation of toners which will enable the development of images in electrophotographic imaging apparatuses, which images have substantially no background deposits thereon, and are of excellent resolution; and further, such toner compositions can be selected for high speed electrophotographic apparatuses, that is those exceeding 70 copies per minute.

In embodiments, the present invention is directed to processes for the preparation of nonpolar toner compositions comprised, for example, of nonpolar resin particles, optional pigment particles, and optional charge enhancing additives comprised of, for example, chromium salicylates, quaternary ammonium hydrogen bisulfates, tetraalkyl ammonium sulfonate, and the like. More specifically, the present invention in embodiments is directed to suspension and polymerization processes for the preparation of nonpolar toner sized particle compositions comprising: (i) preparing an organic phase comprised of a first nonpolar olefinic monomer, a second nonpolar diolefinic monomer, a pigment, a free radical initiator, and optionally a charge control agent; (ii) adding the organic phase to an aqueous phase containing at least one surfactant; (iii) shearing the organic phase into the aqueous phase to form a microdroplet suspension of the organic phase dispersed in the aqueous phase; (iv) heating from ambient temperature to about 90° C. and polymerizing the microdroplets in the suspension to form nonpolar olefinic resin particles; (v) halogenating the nonpolar olefinic resin particle mixture to form nonpolar toner particles having a halopolymer resin outer surface or encapsulating shell; and (vi) optionally isolating the surface halogenated nonpolar toner particles by, for example, filtering the particles, washing repeatedly with water and drying the filter cake using a fluid bed dryer from about 60 minutes to 180 minutes at an a temperature of from about 20° C. to about 60° C. Flow additives to improve flow characteristics and charge additives to improve charging characteristics may then optionally be employed such as AEROSILS ® or colloidal silicas, and the like, of from about 0.1 to about 10 percent by weight of the toner.

Illustrative examples of the nonpolar nonionic monomers useful in the instant invention, include a number of known components such as olefins including, alkyl acrylates, methacrylates, styrene and its derivatives, methyl acrylate, ethyl acrylate, propyl acrylate, butyl acrylate, hexyl acrylate, methyl methacrylate, ethyl methacrylate, propyl methacrylate, butyl methacrylate, hexyl methacrylate, methyl styrene, and the like. Specific examples of nonpolar monomers include styrene, alkyl substituted styrenes, halogenated styrenes, halogenated alkyl substituted styrenes, methylmethacrylate and the like.

Illustrative examples of the nonpolar and nonionic diolefinic or diene monomers useful in the instant invention, include a number of known components such as butadiene, substituted butadienes, for example, methyl butadiene, isoprene, myrcene, alkyl substituted isoprenes, containing from 1 to 25 carbon atoms, mixtures up to 50 percent by weight thereof, and the like.

The polymer or copolymer resins formed by polymerization processes in embodiments of the present invention from the above mentioned monomers are, for example, selected from the group consisting of poly(styrene-butadiene), poly(para-methyl styrene-butadiene), poly(meta-methyl styrene-butadiene), poly(alpha-methylstyrenebutadiene), poly(methylmethacrylatebutadiene), poly(ethylmethacrylatebutadiene), poly(-propylmethacrylate-butadiene), poly(butylmethacrylatebutadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene) and are generally present in the toner composition in various effective amounts depending, for example, on the amount of the other components, and providing many of the objectives of the present invention are achievable. Generally, from about 70 to about 95 percent by weight of the copolymer resin is present in the toner composition, and preferably from about 75 to about 90 percent by weight. The proportion of the two monomers in the copolymer resin is from about 50 to about 95 weight percent of olefin and from about 5 to about 50 weight percent of diolefin or diene.

Typical examples of specific colorants or pigments, preferably present in an effective amount of, for example, from about 3 to about 10 weight percent of toner include Paliogen Violet 5100 and 5890 (BASF), Normandy Magenta RD-2400 (Paul Uhlich), Permanent Violet VT2645 (Paul Uhlich), Heliogen Green L8730 (BASF), Argyle Green XP-111-S (Paul Uhlich), Brilliant Green Toner GR 0991 (Paul Uhlich), Lithol Scarlet D3700 (BASF), Toluidine Red (Aldrich), Scarlet for Thermoplast NSD Red (Aldrich), Lithol Rubine Toner (Paul Uhlich), Lithol Scarlet 4440, NBD 3700 (BASF), Bon Red C (Dominion Color), Royal Brilliant Red RD-8192 (Paul Uhlich), Oracet Pink RF (Ciba Geigy), Paliogen Red 3340 and 3871K (BASF), Lithol Fast Scarlet L4300 (BASF), Heliogen Blue D6840, D7080, K7090, K6902, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlich), Lumogen Yellow D0790 (BASF), Suco-Gelb L1250 (BASF), Suco-Yellow D 1355 (BASF), Sico Fast Yellow D1165, D1355 and D1351 (BASF), Hostaperm Pink E (Hoechst), Fanal Pink D4830 (BASF), Cinquasia Magenta (DuPont), Paliogen Black L0084 (BASF), Pigment Black K801 (BASF) and carbon blacks such as REGAL 330® (Cabot), Carbon Black 5250 and 5750 (Columbian Chemicals), mixtures thereof, and the like.

Examples of surfactants selected for the preparation of toners and processes of the present invention are, for example, sodium dodecylsulfate (SDS), sodium dodecyl-benzenesulfate, sodium dodecylnaphthalenesulfate, dialkyl benzenealkyl, sulfates and sulfonates, polyvinyl alcohol, methalose, methyl cellulose (TYLOSE®), ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol, and the like, and mixtures thereof. An effective concentration of the surfactant or mixture of surfactants generally employed is, for example, from about 0.01 to about 10 percent by weight, and preferably from about 0.1 to about 5 percent by weight of the total monomers used to prepare the copolymer resin.

The aforementioned surfactants of the instant invention function as surfactants during the particle formation stage and as stabilizers during the heating stage of the toner composition preparation process.

Illustrative examples of known free radical initiators that can be selected for the preparation of the toners include azo-type initiators such as 2-2'-azobis(dimethylvaleronitrile), azobis(isobutyronitrile), azobis(cyclohexane-nitrile), azobis(methyl-butyronitrile), mixtures thereof, and the like, peroxide initiators such as benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide, potassium persulfate, ammonium persulfate, sodium bisulfite, combination of potassium persulfate and sodium bisulfite, mixtures thereof, with the effective quantity of initiator being, for example, from about 0.1 percent to about 10 percent by weight of that of core monomer.

Illustrative examples of known low boiling organic solvents, of from about ambient temperature to about 90° C., for the preparation of the toners in embodiments include pentane, hexane, heptane, octane, methyl acetate, ethyl acetate, propyl acetate, Isopar®, dichloromethane, dichloroethane, chloroform, benzene, toluene, tetrahydrofuran, methanol, mixture thereof, and the like.

Illustrative examples of preformed polymeric resin as a finely divided powder or dissolved in an organic solvent for the preparation of the toners in embodiments include poly(styrene-butadiene), poly(para-methylstyrene-butadiene), poly(meta-methyl styrene-butadiene), poly(alpha-methylstyrene-butadiene), poly(methylmethacrylatebutadiene), poly(ethylmethacrylate-butadiene), poly(propylmethacrylatebutadiene), poly(butylmethacrylate-butadiene), poly(methylacrylatebutadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), and the like, and mixtures thereof.

The polymeric resins may be suspended or dissolved in a suitable liquid or solvent. The resins are preferably added to a suitable solvent or a dissolving monomer, that is, where a monomer component also acts as a solvent for dissolving the polymeric component, or alternatively suspended in the organic liquid in the form of a fine powder having a particle size of about 500 microns in diameter or less.

There can also be blended with the toner compositions of the present invention external additive particles including flow aid additives, which additives are usually present on the surface thereof. Examples of these additives include colloidal silicas, such as AEROSIL ®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL ®, can be surface treated with charge additives in an amount of from about 1 to about 30 weight percent and preferably 10 weight percent followed by the addition thereof to the toner in an amount of from 0.1 to 10 and preferably 0.1 to 1 weight percent.

A number of different charge enhancing additives may be selected for incorporation into the bulk toner, or onto the surface of the toner compositions of the present invention to enable these compositions to acquire a positive charge thereon of from, for example, about 10 to about 35 microcoulombs per gram as determined by the known Faraday Cage method for example. Examples of charge enhancing additives include alkyl pyridinium halides, including cetyl pyridinium chloride, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and other similar known charge enhancing additives, such as distearyl dimethyl ammonium bisulfate, and the like, as well as mixtures thereof in some embodiments. These additives are usually present in an amount of from about 0.1 percent by weight to about 15 percent by weight, and preferably these additives are present in an amount of from about 0.2 percent by weight to about 5 percent by weight. A number of different charge enhancing additives may be selected for incorporation into the bulk toner, or onto the surface of the toner compositions of the present invention to enable these compositions to acquire a negative charge thereon of from, for example, about −10 to about −35 microcoulombs per gram. Examples of negative charge enhancing additives include alkali metal aryl borate salts, for example potassium tetraphenyl borate, reference U.S. Pat. No. 4,767,688 and U.S. Pat. No. 4,898,802, the disclosures of which are totally incorporated herein by reference; the aluminum salicylate compound BONTRON E-88 TM available from Orient Chemical Company, reference for example U.S. Pat. No. 4,845,033; the metal azo complex TRH available from Hodogaya Chemical Company; and the like.

Also, there can be included in the toner compositions low molecular weight waxes, such as polypropylenes and polyethylenes commercially available from Allied Chemical and Petrolite Corporation, EPOLENE N-15 ® commercially available from Eastman Chemical Products, Inc., VISCOL 550-P ®, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

The aforementioned toner sized particles obtained from heating and polymerizing the suspended organic phase particles of the toner preparation process are surface halogenated, partially or exhaustively, for example 100 percent, to convert olefinic double bonds by an electrophilic addition reaction in or on the surface polymer chain backbone and reactive pendant groups into the corresponding halogenated hydrocarbon functionality. In many instances, surface halogenation of toner particles affords further control of the variety of rheological properties that may be obtained from the copolymer resins. Surface halogenation is accomplished in embodiments with a gaseous mixture or liquid solution of an effective amount of from 0.01 to about 5 double bond molar equivalents, that is, olefin equivalents on or at the surface of the toner particle, of halogen gas or halogen liquid dissolved in water, or an organic solvent, for example, chlorine gas, liquid bromine, or crystalline iodine dissolved in a solvent, such as an aliphatic alcohol, like ethanol which does not dissolve or substantially alter the size or shape of the toner particles.

A number of equally useful halogenating agents are known that afford equivalent reaction products with olefinic double bonds as the aforementioned diatomic halogens, for example as disclosed by House in "Modern Synthetic Reactions", W. A. Benjamin, Inc., 2nd Ed., Chapter 8, page 422, and references cited therein, the disclosure of which is incorporated in its entirety by reference.

When more reactive halogens such as fluorine ($F_2$) are used, an inert carrier gas, such as argon or nitrogen, may be selected as a diluent, for example, from about 0.1 to about 98 percent by volume of the inert gas relative to the reactive halogen gas, to moderate the heat of reaction and limit the extent of reaction to the olefinic resin, and control the temperature and corrosivity of the halogenation-encapsulation process.

The presence of a halogenated resin shell on the surface of toner particles may be verified using known surface analytical techniques and by X-ray diffraction.

The toner particles obtained from the heating polymerization step are subjected to halogenation, especially chlorination, by, for example, admixing the toner with an aqueous solution of the halogen. Halogens include chlorine, bromine, iodine, and fluorine, with chlorine being preferred. With fluorine, an aqueous solution is not utilized, rather there is selected fluorine with an inert atmosphere. Although it is not desired to be limited by theory, it is believed that the halogen, especially the chlorine, adds across the double bonds of the toner resin particles to form carbon-halogen bonds. The aforementioned halogenation can be considered an electrophilic addition reaction, that is, for example, the halogen reacts with unsaturations or double bonds in the polymer, and, the halogen further diffuses partially into the toner resin below the particle surface, whereby a shell thereof is formed. The shell can be of various effective thicknesses; generally, however, the shell is of a thickness of from about 1 micron or less, and more specifically from about 0.1 to about 1 micron, in embodiments. Typical amounts of halogen consumed include, for example, from about 0.1 to about 1 gram of halogen per 100 grams of toner polymer resin. In an embodiment, the composite particles are admixed with a solution of water and chlorine, which solution has a pH of from about 2.0 to about 3.0, and preferably about 2.5. Specifically, about 150 grams of composite particles can be added in 300 milliliters of an alcohol, such as ethanol, to about 7.5 liters of a chlorine solution at a pH of between about 2.5 and about 3.0, resulting in a pH thereof of from about 2.6 to about 3.2 after about 20 minutes. Generally, from about 100 grams to about 200 grams of toner are admixed with from about 5 to about 10 liters of halogen solution, especially chlorine solution, which solution is comprised of water and halogen, it being noted that a fluorine solution is usually not selected as indicated herein. A sufficient amount of nonpolar toner sized particles and halogen solution are admixed to enable the formation of an effective shell.

Toners obtained by processes of the present invention can be selected for electrophotographic imaging processes including dry and liquid development applications.

The following examples are provided to further define various species of the present invention. These examples are intended to be illustrative only and are not intended to limit the scope of the present invention. The toners prepared in the following Examples had minimum fix temperature values determined by the known crease test as indicated and had hot offset temperature values of greater than 180° C.

EXAMPLE I

A 9.5 micron volume average particle diameter in situ cyan toner comprised of a core containing poly(styrene-butadiene), Heliogen blue pigment and a chlorinated poly(styrene-butadiene) shell was prepared as follows.

A mixture of and 117 grams of styrene and 3.0 grams of Heliogen Blue K7090 pigment, available from BASF, was ball milled for 24 hours. To this mixture were added then 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. This mixture was then cooled to −10° C. wherein 35 grams of liquified butadiene was added (−10° C.). The above corresponding organic phase was then charged into a one liter Parr reactor containing 700 milliliters of a 1.0 percent aqueous TYLOSE ® solution, and the resulting mixture was homogenized for 2 minutes using a Brinkmann polytron operating at 8,000 rpm. TYLOSE ® is a tradename for methylcellulose available from Fluka. During the homogenization, the Parr reactor was cooled in an ice-bath. Thereafter, the mixture was heating to 80° C. whereby the pressure rose to about 40 pounds per square inch over a period of 1 hour, and maintained at this temperature for another 10 hours until the pressure reduced to less than about 5 pounds per square inch. After cooling down to room temperature, the reaction product was washed four times with 100 grams of water until the aqueous extracts were clear, and the product was then suspended in 500 grams of water and treated with chlorine gas until a pH of about 2.5 was achieved. Stirring was then continued for about 30 minutes, after which the product was washed repeatedly four times with 100 grams of with water, concentrated by centrifugation, and freeze dried for 48 hours. The resulting toner sized particle product had a volume average particle diameter of 9.5 microns as measured by a Coulter Counter.

Fifty (50.0) grams of the above prepared dried toner sized particles were dry blended with a mixture of 0.75 gram of AEROSIL R812 ® using a Grey blender with the blending impeller operating at 2,500 rpm. A negatively charged developer was prepared by blending 2 parts by weight of the above toner sized particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of −12.5 microcoulombs per gram as determined in the known Faraday Cage apparatus. Latent images were then formed in a xerographic experimental imaging device similar to the Xerox Corporation 9200 TM, and subsequent the development of images with the aforementioned prepared toner were transferred to a paper substrate and fixed with heat, about 140° C., with a Viton ® fuser roll.

EXAMPLE II

A 7.3 micron average volume particle diameter in situ cyan toner comprised of a core containing poly(styrene-butadiene), Heliogen blue pigment and a chlorinated poly(styrene-butadiene) toner surface shell was prepared as follows.

A mixture of and 117 grams of styrene and 3.0 grams of Heliogen Blue K7090 pigment, available from BASF, was ball milled for 24 hours. To this mixture were added then 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. This mixture was then cooled to −10° C. wherein 35 grams of liquified butadiene was added (−10° C.). The above corresponding organic phase was then charged into a one liter Parr reactor containing 700 milliliters of a 1.0 percent aqueous TYLOSE ® solution, and the resulting mixture was homogenized for 2 minutes using a Brinkmann polytron operating at 8,000 rpm. During the homogenization, the Parr reactor was cooled in an ice-bath. Thereafter, the mixture was heating to 80° C. whereby the pressure rose to about 40 pounds per square inch over a period of 1 hour, and maintained at this temperature for another 10 hours until the pressure reduced to less than about 5 pounds per square inch. After cooling down to room temperature, the reaction product was washed four times with 100 grams of water until the aqueous extracts were clear, and the product was then suspended in 500 grams of water and treated with chlorine gas until a pH of about 2.5 was achieved. Stirring was then continued for about 30 minutes, after which the product was washed four times with 100 grams of water, concentrated by centrifugation, and freeze dried for 48 hours. The resulting toner particle product had a volume average particle diameter of 7.3 microns as measured by the Coulter Counter.

Fifty (50.0) grams of the above prepared dried toner particles were dry blended with a mixture of 0.75 gram of AEROSIL R812® using a Grey blender with its blending impeller operating at 2,500 rpm. A negatively charged developer was prepared as described in Example I. The toner displayed a triboelectric value of −16 microcoulombs per gram as determined in the known Faraday Cage apparatus. Latent images were then formed in a xerographic experimental imaging device similar to the Xerox Corporation 9200 TM, and subsequent the development of images with the aforementioned prepared toner were transferred to a paper substrate and fixed with heat, about 140° C., with a Viton® fuser roll.

EXAMPLE III

A 5.5 micron volume average volume particle diameter in situ cyan toner comprised of a core containing poly(styrene-butadiene), Heliogen blue pigment and a chlorinated poly(strene-butadiene) toner shell was prepared as follows.

A mixture of and 117 grams of styrene and 3.0 grams of Heliogen Blue K7090 pigment available from BASF, was ball milled for 24 hours. To this mixture were added then 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. This mixture was then cooled to −10° C. and added thereto 35 grams of liquified butadiene. The above organic phase was then charged into a one liter Parr TM reactor containing 700 milliliters of a 1.0 percent aqueous TYLOSE® and 0.04 percent sodium dodecylsulfate solution, and the resulting mixture was homogenized for 2 minutes using a Brinkmann polytron operating at 10,000 rpm. During the homogenization, the reactor was cooled in an ice-bath. Thereafter, the mixture was heating to 80° C. whereby the pressure rose to about 40 pounds per square inch over a period of 1 hour, and maintained at this temperature for another 10 hours until the pressure reduced to less than about 5 pounds per square inch. After cooling down to room temperature, the reaction product was washed four times with 100 grams of water until the aqueous phase was clear, and the product was then suspended in 500 grams of water and treated with chlorine gas until a pH of about 2.5 was achieved. Stirring was then continued for about 30 minutes, after which the product was washed four times with 100 grams of water, concentrated by centrifugation, and freeze dried for 48 hours. The resulting toner particle product evidenced a volume average particle diameter of 5.5 microns as measured by a Coulter Counter.

Fifty (50.0) grams of the above prepared dried toner particles were dry blended with a mixture of 0.75 gram of AEROSIL R812® using a Grey blender with its blending impeller operating at 2,500 rpm. A negatively charged developer was prepared as described in Example I. The toner displayed a triboelectric value of −11 microcoulombs per gram as determined in the known Faraday Cage apparatus. Latent images were then formed in a xerographic experimental imaging device similar to the Xerox Corporation 9200 TM, and subsequently the development of images with the aforementioned prepared toner were transferred to a paper substrate and fixed with heat, about 145° C., with a Viton® fuser roll.

EXAMPLE IV

A 6.8 micron volume average particle diameter in situ cyan toner comprised of a core containing (polystyrene-butadiene), Heliogen blue pigment and a chlorinated poly(strene-butadiene) toner shell was prepared as follows.

A mixture of 17 grams of poly(styrene-butadiene), 100 grams of styrene and 3.0 grams of Heliogen Blue K7090 pigment, available from BASF, was ball milled for 24 hours. To this mixture were added then 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. This mixture was then cooled to −10° C. and 30 grams of liquified butadiene was added. The above organic phase was then charged into a one liter Parr TM reactor containing 700 milliliters of a 1.0 percent aqueous TYLOSE® and 0.02 percent sodium dodecylsulfate solution, and the resulting mixture was homogenized for 2 minutes using a Brinkmann polytron operating at 8,000 rpm. During the homogenization, the reactor was cooled in an ice-bath. Thereafter, the mixture was heated to 80° C. whereby the pressure rose to about 40 pounds per square inch over a period of 1 hour, and maintained at this temperature for another 10 hours until the pressure reduced to less than about 5 pounds per square inch. After cooling to room temperature, the reaction product was washed four times with 100 grams of water until the aqueous phase was clear, and the product was then suspended in 500 grams of water and treated with chlorine gas until a pH of about 2.5 was achieved. Stirring was then continued for about 30 minutes, after which the product four times with 100 grams of water, concentrated by centrifugation, and freeze dried for 48 hours. The resulting toner particle product had a volume average particle diameter of 5.5 microns as measured by a Coulter Counter.

Fifty (50.0) grams of the above prepared dried toner particles were dry blended with a mixture of 0.75 gram of AEROSIL R812® using a Grey blender with its blending impeller operating at 2,500 rpm. A negatively charged developer was prepared as described in Example I. The toner displayed a triboelectric value of −13 microcoulombs per gram as determined in the known Faraday Cage apparatus. Latent images were then formed in a xerographic experimental imaging device similar to the Xerox Corporation 9200 TM, and subsequently the development of images with the aforementioned prepared toner were transferred to a paper substrate and fixed with heat, about 150° C., with a Viton® fuser roll.

EXAMPLE V

A 7.0 micron volume average particle diameter in situ cyan toner comprised of a core containing poly(styrene-butadiene), Heliogen blue pigment and a chlorinated poly(strene-butadiene) toner shell was prepared as follows.

A mixture of 150 grams of poly(styrene-butadiene) displaying a glass transition of 41° C. and a weight average molecular weight of 22,000, 3.0 grams of Heliogen Blue K7090 pigment, available from BASF, and 150 grams of dichloromethane was ball milled for 24 hours. This mixture was then charged into a one liter Parr TM reactor containing 700 milliliters of a 1.0 percent aqueous TYLOSE® and 0.02 percent sodium dodecylsulfate solution, and the resulting mixture was homogenized for 2 minutes using a Brinkmann polytron operating at 8,000 rpm. Thereafter, the mixture was stirred at 25° C. whereby the solvent was evaporated. The reaction product was then washed repeatedly with water until the aqueous phase was clear, and the product was then suspended in 500 grams of water and treated with chlorine gas until a pH of about 2.5 was achieved. Stirring was then continued for about 30 minutes, after which the product was washed four times with 100 grams of water, concentrated by centrifugation, and freeze dried for 48 hours. The resulting toner particle product had a volume average particle diameter of 7.0 microns as measured by a Coulter Counter.

Fifty (50.0) grams of the above prepared dried toner particles were dry blended with a mixture of 0.75 gram of AEROSIL R812® using a Grey blender with its blending impeller operating at 2,500 rpm. A negatively charged developer was prepared as described in Example I. The toner displayed a triboelectric value of −12 microcoulombs per gram as determined in the known Faraday Cage apparatus. Latent images were then formed in a xerographic experimental imaging device similar to the Xerox Corporation 9200 TM, and subsequently the development of images with the aforementioned prepared toner were transferred to a paper substrate and fixed with heat, about 135° C., with a Viton® fuser roll.

EXAMPLE VI

A 7.4 micron volume average particle diameter in situ cyan toner comprised of a core containing poly(styrene-butadiene), Hostaperm Pink pigment and a chlorinated poly(styrene-butadiene) toner shell was prepared as follows.

A mixture of 150 grams of poly(styrene-butadiene) displaying a glass transition of 41° C. and weight average molecular weight of 22,000, 7.5 grams of Hostaperm Pink pigment and 150 grams of dichloromethane was ball milled for 24 hours. This mixture was then charged into a one liter Parr TM reactor containing 700 milliliters of a 1.0 percent aqueous TYLOSE® and 0.02 percent sodium dodecylsulfate solution, and the resulting mixture was homogenized for 2 minutes using a Brinkmann polytron operating at 8,000 rpm. Thereafter, the mixture was stirred at 25° C. whereby the solvent was evaporated off. The reaction product was then washed repeatedly with water until the aqueous phase was clear, and the product was then suspended in 500 grams of water and treated with chlorine gas until a pH of about 2.5 was achieved. Stirring was then continued for about 30 minutes, after which the product was washed four times with 100 grams of water, concentrated by centrifugation, and freeze dried for 48 hours. The resulting toner particle product had a volume average particle diameter of 7.5 microns as measured by a Coulter Counter.

Fifty (50.0) grams of the above prepared dried toner particles were dry blended with a mixture of 0.75 gram of AEROSIL R812® using a Grey blender with its blending impeller operating at 2,500 rpm. A negatively charged developer was prepared as described in Example I. The toner displayed a triboelectric value of −13 microcoulombs per gram as determined in the known Faraday Cage apparatus. Latent images were then formed in a xerographic experimental imaging device similar to the Xerox Corporation 9200 TM, and subsequently the development of images with the aforementioned prepared toner were transferred to a paper substrate and fixed with heat, about 135° C., with a Viton® fuser roll.

EXAMPLE VII

A 5 micron volume average particle diameter in situ cyan toner comprised of a core containing poly(styrene-butadiene), Hostaperm Pink pigment and a chlorinated poly(strene-butadiene) toner shell was prepared as follows.

A mixture of 150 grams of poly(styrene-butadiene) displaying a glass transition of 41° C. and weight average molecular weight of 22,000 grams per mole, 7.5 grams of Hostaperm Pink pigment and 150 grams of dichloromethane was ball milled for 24 hours. This mixture was then charged into a one liter Parr TM reactor containing 700 milliliters of a 1.0 percent aqueous TYLOSE® and 0.05 percent sodium dodecylsulfate solution, and the resulting mixture was homogenized for 2 minutes using a Brinkmann polytron operating at 8,000 rpm. Thereafter, the mixture was stirred at 25° C. whereby the solvent was evaporated off by agitation for 24 hours. The reaction product was then washed four times with 100 grams of water until the aqueous phase was clear, and the product was then suspended in 500 grams of water and treated with chlorine gas until a pH of about 2.5 was achieved. Stirring was then continued for about 30 minutes, after which the product was washed four times with 100 grams of water, concentrated by centrifugation, and freeze dried for 48 hours. The resulting toner particle product evidenced a volume average particle diameter of 5 microns as measured by a Coulter Counter.

Fifty (50.0) grams of the above prepared dried toner particles were dry blended with a mixture of 0.75 gram of AEROSIL R812® using a Grey blender with its blending impeller operating at 2,500 rpm. A negatively charged developer was prepared as described in Example I. The toner displayed a triboelectric value of −15 microcoulombs per gram as determined in the known Faraday Cage apparatus. Latent images were then formed in a xerographic experimental imaging device similar to the Xerox Corporation 9200 TM, and subsequently the development of images with the aforementioned prepared toner were transferred to a paper substrate and fixed with heat, about 135° C., with a Viton® fuser roll.

Other modifications of the present invention may occur to those skilled in the art subsequent to a review of the present application, and these modifications are intended to be included within the scope of the present invention.

What is claimed is:

1. A process for the preparation of an in situ toner comprising:

(i) preparing an organic phase comprised of a first nonpolar olefinic monomer, a second nonpolar diolefinic monomer, a pigment, a free radical initiator, and optionally a charge control agent;

(ii) adding the organic phase to an aqueous phase comprised of at least one surfactant;

(iii) shearing the organic phase into the aqueous phase to form a microdroplet suspension of the organic phase dispersed in the aqueous phase;

(iv) heating and polymerizing the microdroplets in the suspension to form nonpolar olefinic resin particles with a volume average diameter particle size of from about 0.5 to about 10 microns;

(v) halogenating the nonpolar olefinic resin particle mixture to form a nonpolar toner having a halopolymer resin outer surface or encapsulating shell; and (vi) optionally isolating the surface halogenated nonpolar toner.

2. A process in accordance with claim 1 wherein the suspension formed in step (iii) is accomplished by homogenizing at from about 1,000 revolution per minute to about 10,000 revolution per minute and at a temperature of from about 10° C. to about 35° C.

3. A process in accordance with claim 1 wherein the halogenation of step (v) of the resin outer surface of the nonpolar olefinic resin particle mixture accomplished with chlorine gas, liquid bromine or aqueous sodium hypochlorite at from about 5 to about 40 degrees centigrade.

4. A process in accordance with claim 1 wherein the nonpolar olefinic resin particles formed in step (iv) are selected from the group consisting of poly(styrene-butadiene), poly(para-methyl styrenebutadiene), poly(-meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(-butylacrylate-butadiene), poly(styrene-isoprene), poly(-para-methylstyrene-isoprene), poly(meta-methylstyrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(-propylacrylate-isoprene), and poly(butylacrylate-isoprene).

5. A process in accordance with claim 1 wherein the nonpolar olefinic resin particles formed in step (iv) are poly(styrene-butadiene).

6. A process in accordance with claim 1 wherein the surfactant is selected from the group consisting of polyvinyl alcohol, methalose, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

7. A process in accordance with claim 1 wherein the pigment is carbon black, magnetite, or mixtures thereof; cyan, yellow, magenta, or mixtures thereof; or red, green, blue, brown, or mixtures thereof.

8. A process in accordance with claim 1 wherein the nonpolar olefinic resin particles formed in step (iv) are from about 3 microns to 21 microns in average volume diameter.

9. A process in accordance with claim 1 wherein the surface halogenated nonpolar toner particles formed in step (v) are from about 0.5 to about 10 micrometers in volume average diameter.

10. A process in accordance with claim 1 wherein the surfactant concentration is about 0.1 to about 5 weight percent of the monomer content in the organic phase of step (i).

11. A process in accordance with claim 1 wherein the toner isolated in step (vi) has a geometric particle size distribution of from about 1.2 to about 1.4.

12. A process in accordance with claim 1 wherein there is added to the surface of the isolated toner of step (vi) surface additives of metal salts, metal salts of fatty acids, silicas, or mixtures thereof, in an amount of from about 0.1 to about 10 weight percent of the toner particles.

13. A toner composition obtained by the process of claim 1 comprising toner particles comprised of pigment particles and nonpolar olefinic resin particles wherein the outer resin surface of the toner particles is a halogenated resin obtained by the reaction of a halogen with the nonpolar olefinic resin.

14. A toner composition in accordance with claim 13 wherein the pigment is carbon black, magnetite, or mixtures thereof; cyan, yellow, magenta, or mixtures thereof; or red, green, blue, brown, or mixtures thereof.

15. A toner composition in accordance with claim 13 wherein the nonpolar olefinic resin is poly(styrene-butadiene) and the halogenated resin is poly(styrene-butadiene-dichlorobutene).

16. A toner composition in accordance with claim 13 wherein the toner particles are from about 3 to 21 micrometers in volume average diameter.

17. A toner composition in accordance with claim 13 wherein the toner particles are from about 3 to 7 micrometers in volume average diameter.

18. A toner composition in accordance with claim 13 wherein the toner particles comprised of pigment particles and nonpolar olefinic resin particles has a glass transition temperature of about 40° to 55° C., and wherein the halogenated resin on the outer surface of the toner particles has a glass transition temperature of about 55° to 65° C.

19. A toner composition in accordance with claim 13 having gloss of from about 45 to about 85 gloss units and a projection efficiency of from about 75 to about 95 percent.

20. A toner comprised of the resin particles obtained by the process of claim 1 and pigment particles.

21. A process for the preparation of an in situ toner comprising:

(i) milling a mixture of a polymeric resin, a pigment and an organic solvent;

(ii) homogenizing the mixture in an aqueous solution containing at least one surfactant;

(iii) heating the homogenized mixture obtained in step (ii) to form toner particles with a volume average diameter particle size of from about 0.5 to about 10,microns;

(iv) halogenating the toner particles to form a toner having a halopolymer resin outer surface or encapsulating shell; and (v) optionally isolating the surface halogenated toner formed in step (iv).

22. A process in accordance with claim 21 wherein the polymeric resin is selected from the group consisting of poly(styrenebutadiene), poly(para-methyl styrene-butadiene), poly(meta-methylstyrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

23. A process in accordance with claim 21 further comprising adding a charge control additive or agent to the mixture of step (i) and wherein the resin is dissolved in an organic solvent.

24. A process in accordance with claim 21, wherein the organic solvent is low boiling and is selected from the group consisting of ethyl acetate, dichloromethane, tetrahydrofuran, chloroform, toluene, benzene, dichloroethane, methyl acetate, propyl acetate, hexanes, pentane, heptane, octane, and mixtures thereof.

25. A process for the preparation of an in situ toner comprising:

(i) preparing an organic phase comprised of a first nonpolar olefinic monomer, a second nonpolar diolefinic monomer, a thermoplastic resin, a pigment, a free radical initiator that is suspended or dissolved in the organic phase, optionally an organic solvent, and optionally a charge control agent;

(ii) adding the organic phase to an aqueous phase containing at least one surfactant;

(iii) shearing the organic phase into the aqueous phase to form a microdroplet suspension of the organic phase dispersed in the aqueous phase;

(iv) heating and polymerizing the microdroplets in the suspension to form a mixture of nonpolar olefinic resin particles with a volume average diameter particle size of from about 0.5 to about 10 microns;

(v) halogenating the nonpolar olefinic resin particle mixture to form a nonpolar toner having a halopolymer resin outer surface or encapsulating shell; and (vi) optionally isolating the surface halogenated nonpolar toner.

26. A process in accordance with claim 25, wherein the thermoplastic resin added in step (i) or the resin formed in step (iv) is selected from the group consisting of poly(styrene-butadiene), poly(para-methylstyrene-butadiene), poly(meta-methylstyrene-butadiene), poly(alpha-methylstyrene-butadiene), poly(methylmethacrylatebutadiene), poly(ethylmethacrylate-butadiene), poly(propylmethacrylatebutadiene), poly(butylmethacrylate-butadiene), poly(methylacrylatebutadiene), poly(ethylacrylate-butadiene), poly(propylacrylate-butadiene), poly(butylacrylate-butadiene), poly(styrene-isoprene), poly(para-methylstyrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

* * * * *